United States Patent [19]

Karalis

[11] 4,122,574

[45] Oct. 31, 1978

[54] METHOD OF MAKING FOOTWEAR

[75] Inventor: Victor L. Karalis, Naugatuck, Conn.

[73] Assignee: Uniroyal, Inc., New York, N.Y.

[21] Appl. No.: 787,408

[22] Filed: Apr. 14, 1977

[51] Int. Cl.[2] ..... A43D 9/00; A43C 13/08

[52] U.S. Cl. ..... 12/142 RS; 36/14

[58] Field of Search ..... 12/142 R, 142 RS; 36/14, 19.5, 83, 4, 7.3, 87

[56] References Cited

U.S. PATENT DOCUMENTS

| | | | |
|---|---|---|---|
| 1,735,986 | 11/1929 | Wray | 36/14 |
| 1,937,074 | 11/1933 | Vicente | 36/14 |
| 3,029,823 | 4/1962 | Zerkowitz | 36/14 |
| 3,044,189 | 7/1962 | Noda | 36/14 |
| 3,175,308 | 3/1965 | Werman et al. | 36/14 |

*Primary Examiner*—Patrick D. Lawson

*Attorney, Agent, or Firm*—Charles A. Blank

[57] ABSTRACT

An article of footwear and method of making the same which does not require adhesives on the upper to attach a smooth upper to an insole, outsole and foxing. A first strip having an outer surface of uncured elastomeric material is stitched to the lower edge of the upper and a second strip having inner and outer surfaces of uncured elastomeric material is stitched to the first strip at approximately a right angle thereto. An insole and an outsole are attached to the inner and outer surfaces, respectively, of the second strip.

6 Claims, 12 Drawing Figures

Fig. 5.
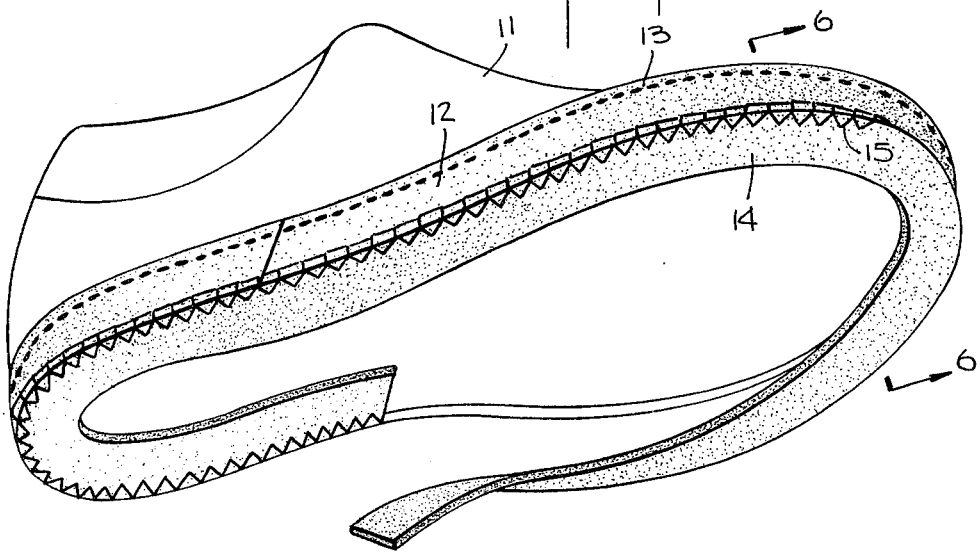
Fig. 8.
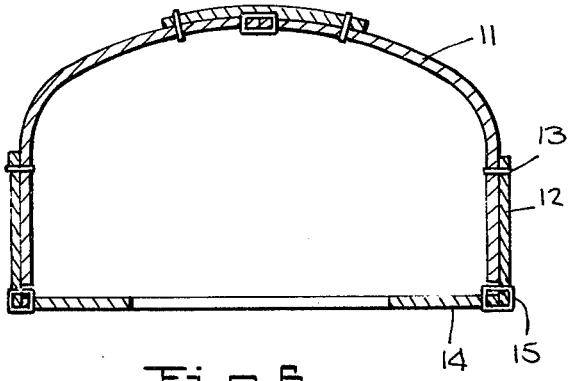
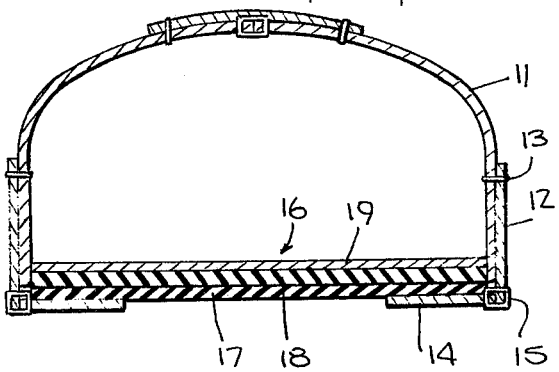
Fig. 6.
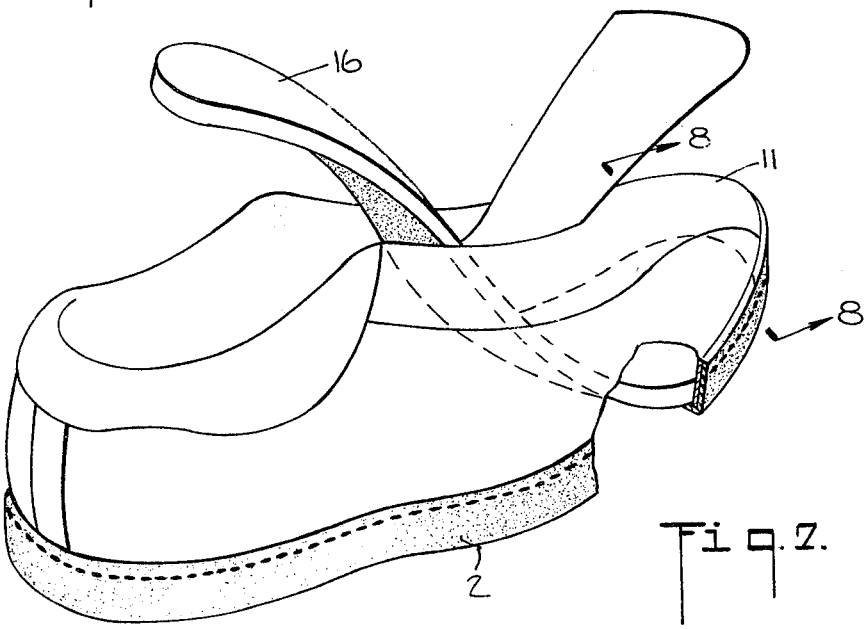
Fig. 7.

Fig. 9.
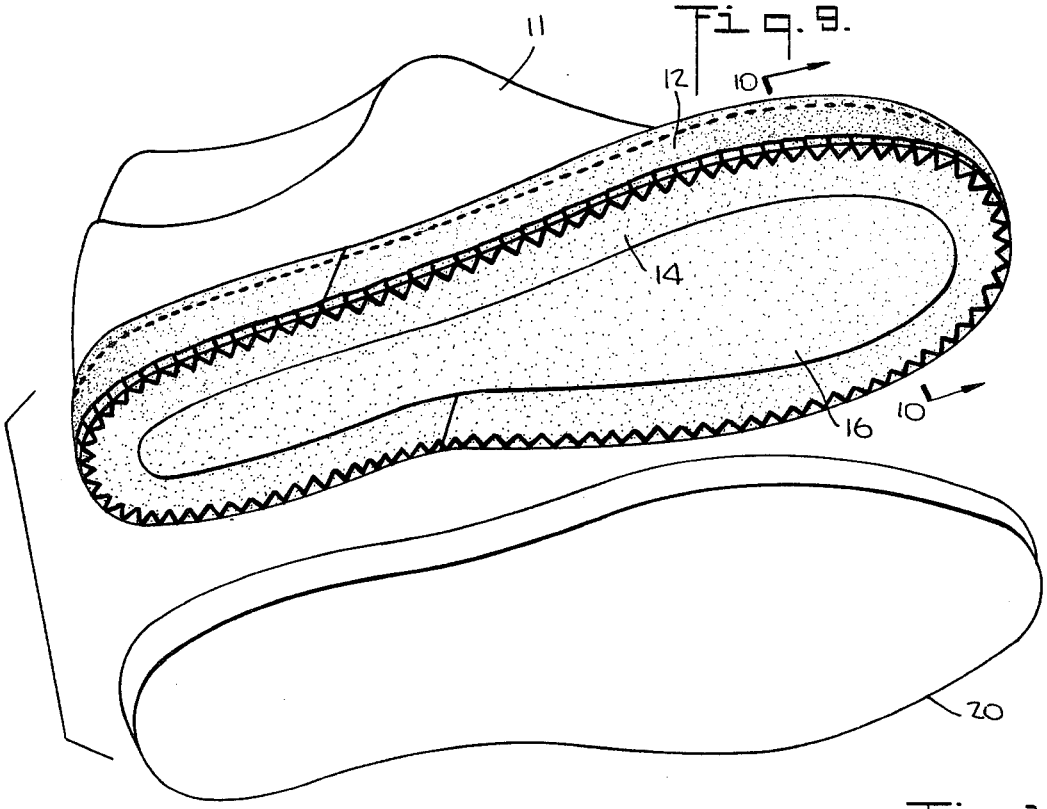
Fig. 10.
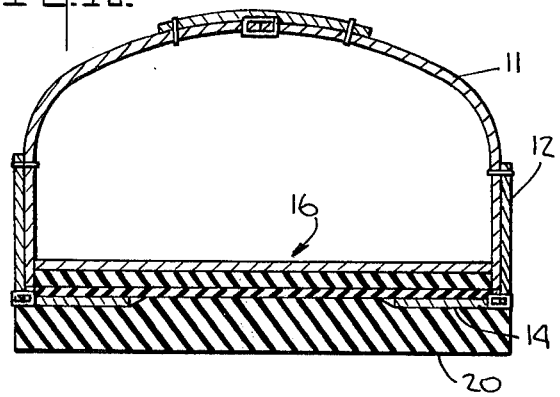
Fig. 12.
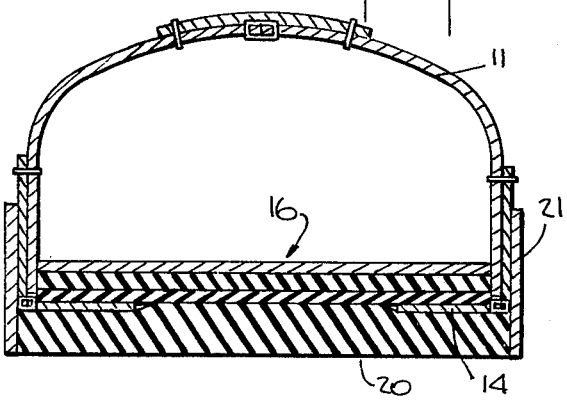
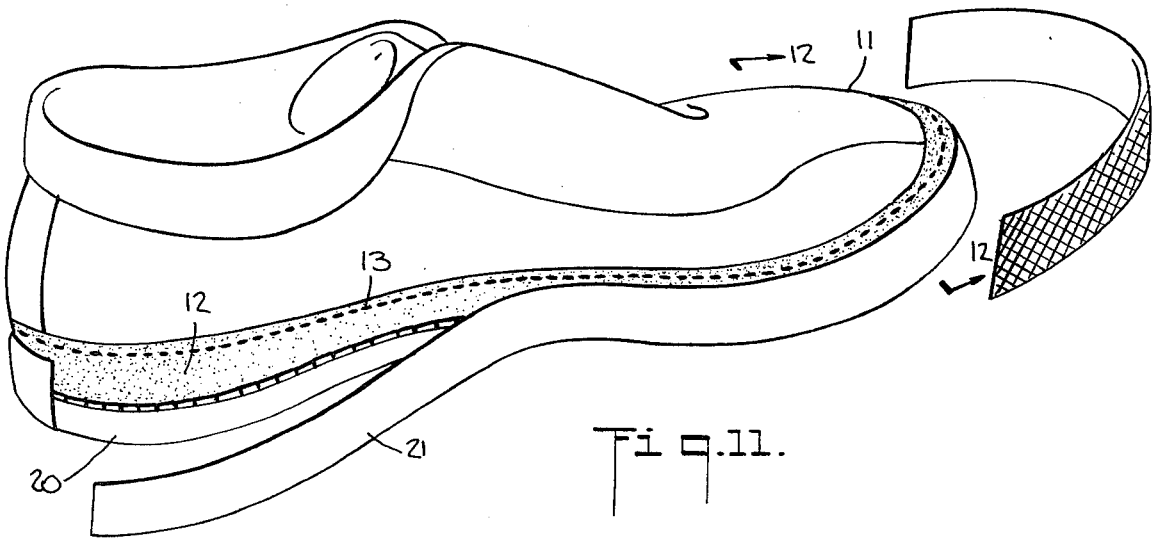
Fig. 11.

METHOD OF MAKING FOOTWEAR

This invention relates to an article of footwear and the method of making the same and, more particularly, to a shoe and the method of making the shoe.

Heretofore, it has been difficult to attach an insole, outsole and a foxing to a shoe upper of, for example, smooth leather or nylon and adhesives of special composition have been required.

It is an object of the present invention, therefore, to provide a new and improved article of footwear and method of making the same.

It is another object of the invention to provide a new and improved shoe which does not require adhesives on the upper to attach the upper to an insole, outsole, and foxing.

It is another object of the invention to provide a new and improved method of making a shoe which attaches the upper, insole, outsole and foxing without requiring special adhesives or special lasts.

In accordance with the invention, an article of footwear comprises an upper; a first strip having an outer surface comprising elastomeric material stitched to the lower edge of said upper; a second strip having inner and outer surfaces comprising elastomeric material stitched to said first strip at approximately a right angle thereto; an insole having a bottom surface; the inner surface of the second strip being attached to the bottom surface of the insole; and an outsole having a top surface; the outer surface of the second strip being attached to the top surface of the outsole.

Also in accordance with the invention, the method of making an article of footwear comprises stitching a first strip having an outer surface comprising uncured elastomeric material to the lower edge of an upper of an article of footwear; stitching a second strip having inner and outer surface comprising uncured elastomeric material to said first strip at approximately a right angle thereto; attaching the inner surface of the second strip to the bottom surface of an insole; and attaching the outer surface of the second strip to the top surface of an outsole.

For a better understanding of the present invention, together with other and further objects thereof, reference is made to the following description, taken in connection with the accompanying drawings and its scope will be pointed out in the appended claims.

Referring now to the drawings:

FIG. 5 is a perspective view of a partially completed shoe with a second strip stitched to the first strip;

FIG. 6 is a sectional view of the FIG. 5 shoe, taken along line 6—6 of FIG. 5 but with the second strip fully stitched to the first strip;

FIG. 7 is a perspective view of a partially completed shoe with an insole partially inserted therein;

FIG. 8 is a sectional view of the FIG. 7 partially completed shoe, taken along line 8—8 of FIG. 7;

FIG. 9 is a perspective view of a partially completed shoe and outsole to be applied thereto;

FIG. 10 is a sectional view of the FIG. 9 shoe but with the outsole attached thereto, taken along line 10—10 of FIG. 9.

FIG. 11 is a sectional view of a partially completed shoe with a foxing partially applied thereto and with a bumper strip ready for application thereto; and FIG. 12 is a sectional view of the FIG. 11 shoe, taken along line 12—12 of FIG. 11.

Figure 1:
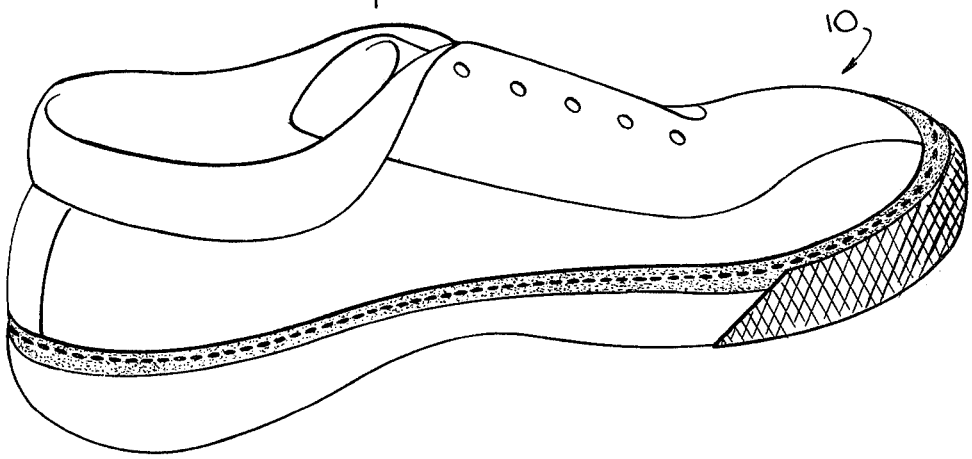
FIG. 1 is a perspective view of a shoe constructed in accordance with the invention.
Figure 2:
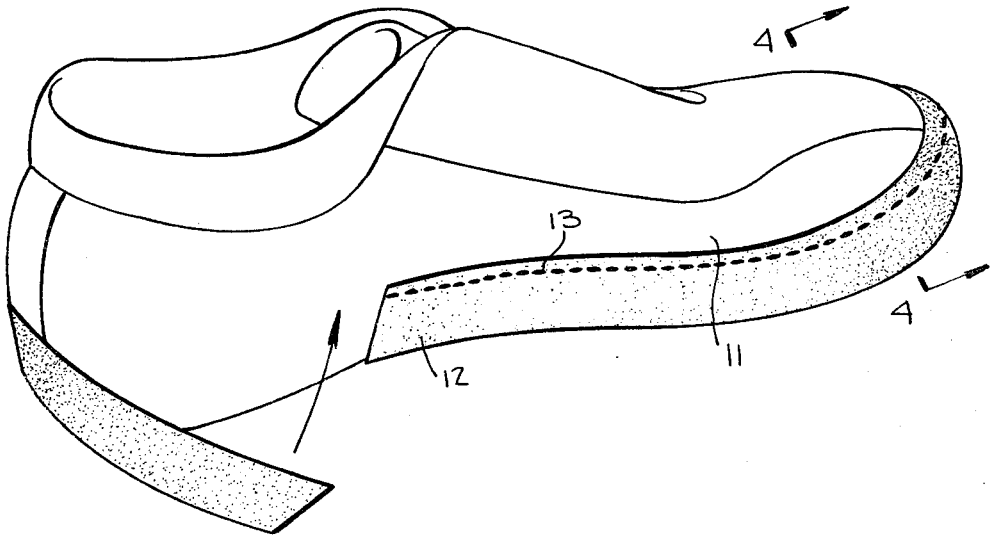
FIG. 2 is a perspective view of the upper of the FIG. 1 shoe with a first strip partially stitched thereto.
Figure 3:
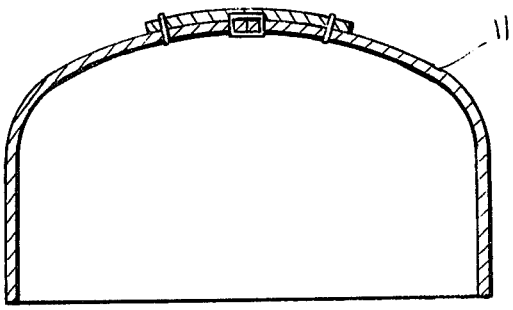
FIG. 3 is a sectional view of the upper of FIG. 2 before the first strip is stitched thereto, taken along the same line of FIG. 2 as the FIG. 4 view.
Figure 4:
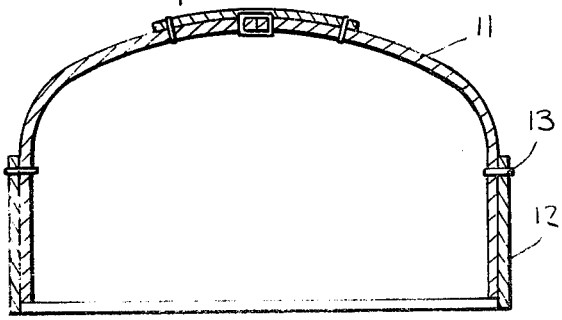
FIG. 4 is a sectional view of the upper and first strip of FIG. 2, taken along line 4—4 of FIG. 2.

Referring now more particularly to FIG. 1 of the drawings, there is represented a completed article of footwear, for example, a shoe 10 constructed in accordance with the invention. Referring to FIG. 2, the shoe 10 comprises an upper which may be of, for example, smooth leather or nylon. The method of making an article of footwear in accordance with the invention comprises stitching a first strip 12 having an outer surface comprising uncured elastomeric material to the lower edge of the upper 11. The stitches are represented in broken-line construction 13 and may be of any suitable material, for example, nylon. A sectional view of the upper with the strip 12 stitched thereto is represented in FIG. 4, taken along line 4—4, of FIG. 2. A sectional view of the upper before the strip 12 is stitched thereto, taken along the same line 4—4 of FIG. 2, is represented in FIG. 3. The strip 12 may, for example, be a strip of fabric having on the outer surface thereof a layer of conventional gum rubber compound.

Referring to FIG. 5 of the drawings, the method comprises stitching a second strip 14 having inner and outer surfaces comprising uncured elastomeric material to said first strip 12 at approximately a right angle thereto. The second strip 14 comprises, for example, a strip of fabric having inner and outer surfaces comprising uncured elastomeric material, for example, conventional gum rubber compound, and stitched to the first strip 12 at approximately a right angle thereto. By the phrase "approximately a right angle" is meant an angle in the range of 75° to 105° . The stitches between the first and second strips are represented in solid-line construction 15 and may be of any suitable material, for example, nylon. A sectional view of the upper 11 with the strip 14 preferably loosely stitched to the strip 12 is represented in FIG. 6, taken along line 6—6 of FIG. 5, but with the stitching of the strip 12 completed.

As represented in FIG. 7 an insole 16 may be inserted in the upper 10 and the method comprises attaching the inner surface of the strip 14 to the bottom surface of the insole 16. The strip 14 may be pressed by hand into firm attachment with the insole, preferably tightly attaching the heel region first to provide best shaping of the strip 14 around the insole 16. The insole 16 may comprise a plurality of layers of elastomeric material 17, 18 of, for example, a conventional rubber compound and covered by a fabric layer 19, as represented in section in FIG. 8, which is a sectional view taken along line 8—8 of FIG. 7 after the second strip 14 has been firmly attached thereto. A conventional cement may be used on the bottom of insole layer 17 to attach the strip 14 thereto.

Referring now to FIG. 9, the method comprises attaching the outer surface of the second strip 14 to the top surface of the outsole 20. This may be accomplished by pressing the outsole 20 by hand into firm attachment with the strip 14. The outsole 20 may be, for example, a molded, vulcanized outsole of elastomeric material, for example, a conventional rubber compound. A conventional cement is utilized at the top of the outsole 20 to attach the strip 14 thereto. FIG. 10 is a sectional view of the shoe of FIG. 9, taken along line 10—10 of FIG. 9, with the outer surface of the second strip 14 being attached to the top surface of the outsole 20.

As represented in FIG. 11, the method may also comprise attaching a foxing 21 to the outer surface of the first strip 12 and to the outsole 20. A conventional cement is utilized at the edges of the outsole to adhere the outsole to the foxing, which may comprise a layer of fabric having an outer surface of elastomeric material, for example, a conventional rubber compound. If desired, an additional strip (not shown) having inner and outer surfaces of elastomeric material, for example, a conventional gum rubber compound, may be attached to the strip 12 and to the outsole 20 under the foxing 21 and covering the stitches 13. A sectional view of the FIG. 11 shoe, taken along line 12—12 of FIG. 11 before the application of a conventional rubber bumper strip, is represented in FIG. 12.

The method preferably also comprises the step of curing the shoe 10 in a conventional manner.

As used herein, the term "elastomeric" refers to and is intended to include, but not be limited to, natural and synthetic elastomers, elastomeric blends, compositions and compounds.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

I Claim:

1. The method of making an article of footwear comprising:

stitching a first strip having an outer surface comprising uncured elastomeric material to the lower edge of an upper of an article of footwear;

stitching a second strip having inner and outer surfaces comprising uncured elastomeric material to said first strip at approximately a right angle thereto;

attaching said inner surface of said second strip to the bottom surface of an insole; and attaching said outer surface of said second strip to the top surface of an outsole.

2. The method in accordance with claim 1 in which the step of stitching a first strip to the lower edge of an upper comprises stitching a first strip to the lower edge of a smooth leather upper of a shoe.

3. The method in accordance with claim 1 in which the step of stitching a first strip to the lower edge of an upper comprises stitching a first strip to the lower edge of a nylon upper of a shoe.

4. The method in accordance with claim 1 which includes the step of attaching a foxing to the outer surface of said first strip and to said outsole.

5. The method in accordance with claim 1 which includes the step of curing said article of footwear.

6. The method in accordance with claim 1 wherein said step of stitching a first strip to the lower edge of an upper comprises stitching a first strip of fabric having an outer surface comprising uncured elastomeric material to said lower edge of said upper and said step of stitching a second strip to said first strip comprises stitching a second strip of fabric having inner and outer surfaces comprising uncured elastomeric material to said first strip.

* * * * *